US009622565B2

(12) United States Patent
Weigel et al.

(10) Patent No.: US 9,622,565 B2
(45) Date of Patent: Apr. 18, 2017

(54) SIMPLIFED SEALING CAP WITH THREAD OR BAYONET CLOSURE AND ONE-PIECE APPLICATOR EQUIPPED THEREWITH

(71) Applicant: GEKA GmbH, Bechhofen (DE)

(72) Inventors: Friedrich Weigel, Wittelshofen (DE); Werner Fischer, Burk (DE)

(73) Assignee: GEKA GmbH, Bechhofen (DE)

( * ) Notice: Subject to any disclaimer, the term of this patent is extended or adjusted under 35 U.S.C. 154(b) by 337 days.

(21) Appl. No.: 14/449,701

(22) Filed: Aug. 1, 2014

(65) Prior Publication Data

US 2015/0071696 A1 Mar. 12, 2015

(30) Foreign Application Priority Data

Aug. 2, 2013 (DE) ..... 20 2013 006 927 U

(51) Int. Cl.

| | |
|---|---|
| ***A45D 40/26*** | (2006.01) |
| ***A46B 9/02*** | (2006.01) |
| ***A45D 33/18*** | (2006.01) |
| ***B65D 41/02*** | (2006.01) |

(52) U.S. Cl.

CPC ..... *A45D 40/265* (2013.01); *B65D 41/02* (2013.01); *A46B 2200/1053* (2013.01)

(58) Field of Classification Search

CPC ..... B65D 41/02; A45D 40/265
USPC ..... 401/126
See application file for complete search history.

(56) References Cited

U.S. PATENT DOCUMENTS

| | | | | |
|---|---|---|---|---|
| 8,001,981 | B2 * | 8/2011 | Jeong | A45D 40/267 132/218 |
| 8,303,205 | B2 * | 11/2012 | Luo | A45D 40/265 132/218 |
| 2006/0165472 | A1 * | 7/2006 | Dumler | A45D 34/045 401/126 |
| 2008/0066774 | A1 * | 3/2008 | Befve | A45D 34/045 132/218 |
| 2009/0194120 | A1 * | 8/2009 | Pires | A45D 40/265 132/200 |
| 2010/0104348 | A1 * | 4/2010 | Rauschert | A45D 40/268 401/122 |
| 2010/0166488 | A1 * | 7/2010 | Bouix | A45D 40/26 401/122 |
| 2010/0212682 | A1 * | 8/2010 | Pires | A45D 40/265 132/218 |
| 2010/0224208 | A1 * | 9/2010 | Thorpe | A45D 40/265 132/218 |

(Continued)

FOREIGN PATENT DOCUMENTS

WO 2006132459 A1 12/2006

*Primary Examiner* — Mark A Laurenzi
*Assistant Examiner* — Thomas M Abebe

(57) ABSTRACT

An injection-molded plastic sealing cap having a tubular cap body with a longitudinal axis, which cap body transitions integrally into a plate that extends at least predominantly in a radial direction, in which the inner circumference of the tubular cap body has at least one holding projection that protrudes radially inward into the inner space that is circumferentially encompassed by the cap body, wherein the plate has a window that is associated with the at least one holding projection and is aligned with the holding projection with which it is associated, viewed in the direction of the longitudinal axis of the sealing cap.

20 Claims, 12 Drawing Sheets

(56) References Cited

U.S. PATENT DOCUMENTS

| | | | | |
|---|---|---|---|---|
| 2010/0307529 | A1* | 12/2010 | Schwab | A45D 33/18 132/218 |
| 2011/0030716 | A1* | 2/2011 | Lou | A45D 40/265 132/218 |
| 2011/0088712 | A1* | 4/2011 | Pires | A45D 40/265 132/200 |
| 2011/0088713 | A1* | 4/2011 | Luo | A45D 40/265 132/218 |
| 2012/0039660 | A1* | 2/2012 | Suzuki | A45D 40/267 401/122 |
| 2012/0045268 | A1* | 2/2012 | Geuther | A45D 34/045 401/121 |
| 2012/0170961 | A1* | 7/2012 | Bouix | A45D 40/0087 401/1 |
| 2012/0282009 | A1* | 11/2012 | Geuther | A45D 40/265 401/126 |
| 2014/0037360 | A1* | 2/2014 | Hofmann | A45D 40/265 401/129 |
| 2014/0246043 | A1* | 9/2014 | Befve | A46B 3/005 132/218 |
| 2014/0376988 | A1* | 12/2014 | Fischer | A46B 9/021 401/129 |

* cited by examiner

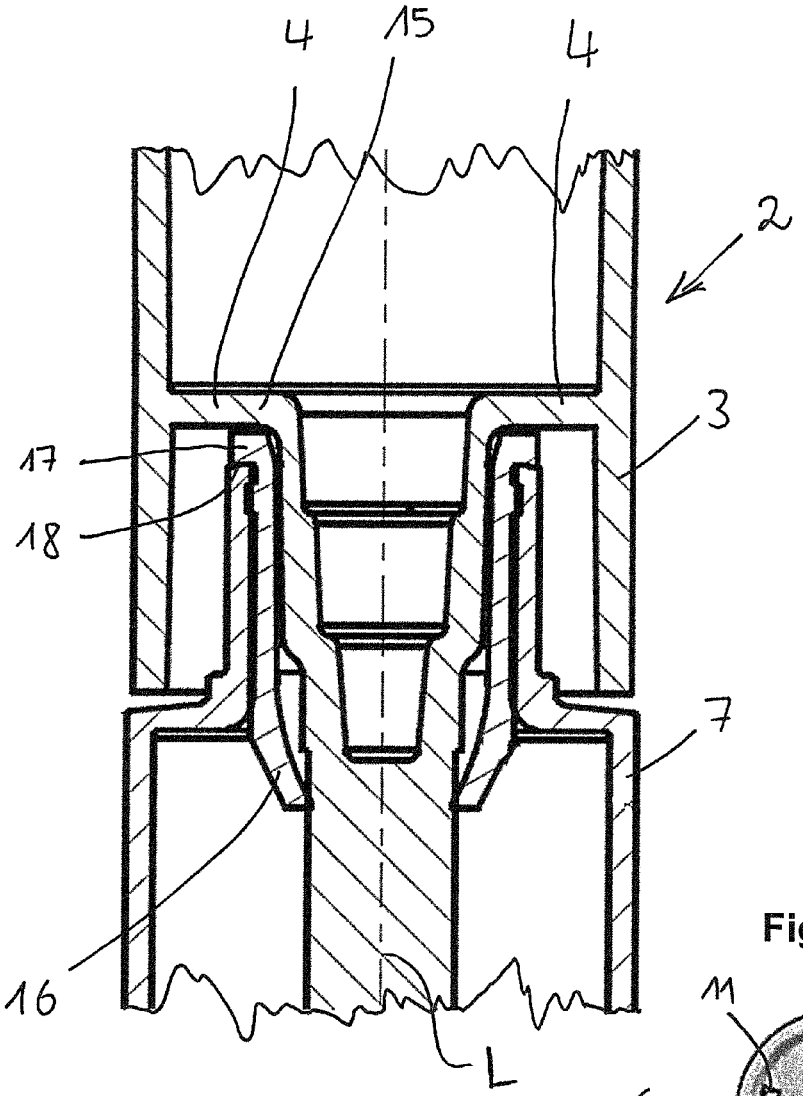
Fig. 9
Fig. 10
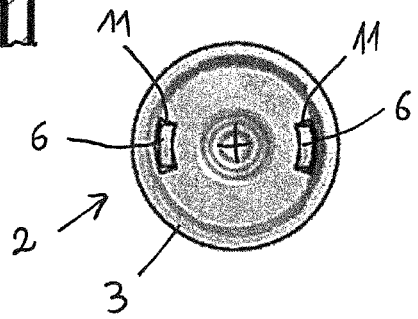

SIMPLIFED SEALING CAP WITH THREAD OR BAYONET CLOSURE AND ONE-PIECE APPLICATOR EQUIPPED THEREWITH

FIELD OF THE INVENTION

The invention relates to a simplified sealing cap, as well as a cosmetic applicator equipped therewith.

BACKGROUND OF THE INVENTION

Sealing caps of this kind for cosmetic applicators, which are composed of a tubular cap body whose interior is divided into two regions by a plate to which is attached a wand or shaft that in turn holds the actual applicator, are widely used in the cosmetics industry.

As a rule, the plate also performs the task of providing a sealing surface, which, when the sealing cap is completely closed, is pressed against the bottle neck or against the rim of the stripper protruding from this neck, in order to reliably seal the cosmetic receptacle.

In order to be able to exert the sealing pressure required for this as conveniently as possible, the cap body is provided, usually on its inner circumferential surface, with a thread profile that protrudes relatively far in the radial direction into the open space encompassed by the cap body. The thread profile constitutes a holding projection: with the aid of this thread profile, the sealing cap can be screwed onto a receptacle provided with a complementary thread groove until the plate rests with the pressure required for a reliable seal against the end surface of the receptacle neck or the stripper that encompasses this end surface.

It has, however, long been known that the thread stands in the way of a truly efficient manufacture of the sealing cap. The problem is that as a rule, these sealing caps are manufactured by means of injection molding. To this end, an injection mold is used, which is composed of two parts, between which is formed the mold cavity that produces the sealing cap. To remove the completed injection molded sealing cap from the mold, the two mold halves are pulled apart from each other in the direction parallel to the longitudinal axis of the sealing cap. However, the sealing cap is not yet completely free, even when the two mold halves are pulled all the way apart from each other. Instead, it remains attached at first to the mold half that provides the core that has produced the internal thread on the inner circumference of the cap body. In order to remove the sealing cap, it must then be unscrewed from this core in a subsequent work step. Since this problem has already existed for a long time, corresponding robots have already long ago been developed, which perform this unscrewing in a fully automated fashion. Nevertheless, the necessity for such an unscrewing increases the cycle time and necessarily incurs an additional equipment expense.

A similar problem arises in the manufacture of a sealing cap that does not in fact have a thread profile, but instead has a bayonet closure. Such a closure likewise functions with a holding projection that protrudes relatively far in the radial direction into the open space encompassed by the cap body.

In the low-budget sector, therefore, sealing caps are consistently used, which instead of an internal thread, use an elastic detent bead, which does indeed also protrude inward, but only so slightly that the sealing cap, with the aid of the linear movement of a correspondingly strong ejector, can be slid downward by the core that forms the detent mechanism, because it can expand elastically enough for the detent bead to be pulled out of the recess in the mold in which it has been formed. Such detent closures often do not remain really leak-proof over the long term since with the aid of such a detent closure, it is difficult over the long term to exert relatively powerful forces that act in the direction of the longitudinal axis L and prestress the sealing surfaces against each other with sufficient force.

In light of this, the object of the invention is to create a sealing cap that can be efficiently manufactured, even though it is provided with a holding projection that protrudes farther in the radial direction into the open space encompassed by the cap body than a mere detent bead.

SUMMARY OF THE INVENTION

According to the invention, an injection-molded plastic sealing cap is provided with a tubular cap body that has a longitudinal axis, which in many instances (but not always) will simultaneously be the symmetry axis of the sealing cap.

The cap body transitions integrally into a plate that extends at least predominantly in a radial direction.

In this case, the inner circumference of the tubular cap body is provided with at least one holding projection, which, in relation to the longitudinal axis of the tubular cap body, protrudes more than just slightly in an essentially radial direction into the open space that is circumferentially encompassed by the cap body—as a rule, the holding projection is part of a form-fitting holding mechanism by means of which it is possible to exert a holding force that is more than just insignificant in the direction of the longitudinal axis of the cap or of the receptacle associated with it. This holding mechanism is most often a thread or a bayonet closure, but in other embodiments, can be another holding mechanism that locks tight in a form-fitting manner so that the sealing cap cannot be unlocked again by purely tensile forces in the direction of the longitudinal axis.

According to the invention, the plate has a window that is associated with the at least one holding projection and is aligned with the holding projection with which it is associated, viewed in the direction of the longitudinal axis of the sealing cap. Via this window, the space situated between the holding projection and the plate, viewed in the direction of the longitudinal axis, is accessible from the side of the plate oriented away from the holding projection. This has quite a considerable advantage during the injection molding of the sealing cap because the injection mold used for this can be designed so as to significantly facilitate the removal of the completed injection-molded cap from the mold.

The injection mold can then be designed specifically so that for the removal procedure, the at least two parts of the mold can be moved away from each other in the direction of the longitudinal axis L and this action also releases the sealing cap. This is possible because the region in the sealing cap—which region is situated between the holding projection and the plate, viewed in the direction along the longitudinal axis, and which region actually represents a so-called undercut in the eyes of a mold designer—does not have to be produced by the mold part oriented toward the holding projection, but can instead be produced by the mold part oriented away from the holding projection, which latter mold part has a protruding extension for this purpose that protrudes through the window into the undercut between the holding projection and the plate.

In a somewhat more general way, it can be said that the invention is comprised of the fact that the sealing cap is provided with a tubular cap body with a longitudinal axis, which cap body transitions integrally into a plate that extends at least predominantly in a radial direction, and the inner circumference of the tubular cap body has at least one holding projection that protrudes radially inward into the inner space (8) that is circumferentially encompassed by the cap body and as a result, forms an undercut when viewed from the end opening of the tubular cap body oriented toward the holding projection, characterized in that the plate has a window that is associated with the at least one holding projection and through which it is possible to access the undercut from the end opening of the tubular cap body oriented away from the holding projection so that during production, from the end opening oriented away from the holding projection, a mold part can be slid into the region of the undercut in order to fill it, specifically so that no undercut is produced for the other mold part.

Preferably, the window is designed so that the cross-sectional area of the window is greater than the projected area of the holding projection with which it is associated, viewed in the direction of the longitudinal axis. This makes it possible for the extension that protrudes through the window to become thicker from its free end to its base because it is beveled, for example on the sides, in a conical or pyramid-shaped fashion, which improves its sealing action, for example.

Preferably, the plate is positioned in the tubular cap body so that it divides the latter into two sections, each of which has the shape of a tube that is open at the end. Particularly in cosmetic applicators, this improves handling significantly because the part of the tubular cap body protruding beyond the plate and oriented away from the applicator constitutes a counterweight to the applicator, which is fastened to the plate via a shaft or wand, so that the center of gravity of the whole system is shifted more in the direction of the middle of the cap ("middle" in relation to the longitudinal axis).

Preferably, the plate transitions into a shaft, which supports an applicator or has a coupling for the attachment of a shaft that supports an applicator.

The invention also relates to a particularly efficient-to-produce applicator with a handle, a wand, and a set of bristles as well as a method for manufacturing such an applicator. In the prior art up to now, the systematic approach has been for cosmetic applicators to be manufactured by separately producing a handle, a wand, and a bristle support with bristles extending radially out from it; these were then assembled in a subsequent step.

This approach is laborious. At the same time, this approach is also not without hygiene-related problems because particularly in the region in which the coupling section of bristle support is affixed in the wand, a narrow gap remains, which cannot in practice be completely sealed. Left-over cosmetic can collect in this gap and under unfavorable conditions, can encourage fungal or bacterial infection.

Another object of the invention is to ameliorate this situation.

This object is attained by means of a cosmetic applicator of the kind described herein.

Such a cosmetic applicator, which is in particular embodied in the form of a mascara applicator, is provided with a sealing cap whose outside is embodied in the form of a gripping surface. The sealing cap serves to tightly close a cosmetic receptacle and is embodied according to the invention in that its plate has at least one window that is aligned with the at least one holding projection, viewed in the direction of the longitudinal axis. The sealing cap transitions integrally into a shaft protruding from it. The shaft comprises a wand section and, integrally joined to it, a bristle-supporting section, i.e. the wand section and the bristle-supporting section transition seamlessly into each other and are embodied as a one-piece component. In addition, bristles protrude from the bristle-supporting section, which are embodied as an integral component of the bristle-supporting section in that they are connected to the bristle-supporting section in an undetachable, form-fitting way by means of welding. This connection is achieved through the particular embodiment of the bristle-supporting section. As such, the bristle-supporting section is specifically embodied as hollow on the inside and supports injection-molded bristles, which are integrally connected through the wall of the bristle-supporting section to a plastic core that lines the interior of the bristle-supporting section. The sealing cap and the shaft (made up of the wand section and bristle support) in this case are preferably composed of a different plastic material than the plastic core and the bristles. Ideally, these two plastic materials are selected so that they weld to each other during the injection molding of the bristles.

According to the invention, the bristles, the wand, and the cap consequently form a one-piece component. Embodying the cap according to the invention makes a significant contribution to the efficient manufacture of the applicator according to the invention since it makes the applicator, which has been produced as a single piece, significantly easier to remove from the mold. The previously required work step of inserting a coupling piece of a bristle support provided with bristles into a hollow wand and the subsequent permanent bonding of these two individual parts to each other is no longer necessary. This significantly reduces the price of the applicator according to the invention because it can be produced by means of two successive injection-molding procedures, which can be performed one after the other in a fully automatic way.

Even from a hygiene standpoint, the applicator according to the invention is advantageous because there are no assembly-related seams anywhere on it into which the cosmetic compound could penetrate, remain permanently, and then over the course of time, potentially constitute an incubator for infection.

Preferably, wherever two different plastics have been mentioned above, the first plastic compound that constitutes the bristles is composed of a plastic that in the chilled state, is more flexible and/or has a better "bend recovery capacity" than the plastic of which the second plastic compound is composed, which preferably constitutes the cap and/or the shaft. A plastic that is particularly well-suited for producing the first plastic compound is the plastic type that is marketed under the brand name "Grilflex"®. Polypropylene (PP) is particularly well-suited for the second plastic compound.

There are no serious gaps in the region of the bristle set either.

In this case, this is also true where the bristles are integrally connected to a plastic core that lines the interior of the bristle-supporting section and extend locally through the wall of the bristle-supporting section. Overall, there is an especially intimate connection between the second plastic material, which forms the bristles and is the same plastic material that fills the inside of the bristle-supporting section, and the tubular bristle-supporting section. There are no gaps anywhere that can be colonized by bacteria or fungi. Preferably, the cosmetic applicator is embodied so that the cavity of the bristle-supporting section is open toward the outside at the end surface of the bristle-supporting section oriented away from the cap. This enables a particularly favorable, bubble-free injection of the plastic compound, which is intended to locally penetrate the wall of the bristle-supporting section and form the bristles.

Ideally, the bristle-supporting section is embodied so that it has at least essentially constant wall thickness, which is ideally ≤1 mm and even better, ≤0.75 mm.

According to a preferred embodiment, the wand section is at least partially hollow and on its interior, has a dividing section that divides its cavity from the cavity of the bristle-supporting section in a pressure-tight way so that even under the influence of an injection molding pressure of several hundred bar, no perforation occurs.

Ideally, the end of the wand section oriented away from the handle is solid and thus constitutes a dividing section that represents approximately ⅕ to ½ of the total length of the wand section and provides for a reliable seal. In this way, the wand section provides a reliable seal even if the cycle times are kept relatively short and the wand section that is injection molded together with the cap in a first step has not yet completely cooled by the time the bristles are injection molded into it in a second step.

In a design that is particularly reliable and stable, the wall thickness of the bristle-supporting section increases just before the transition of the bristle-supporting section into the wand section. In this case, the wall thickness of the bristle-supporting section preferably increases toward the inside.

In a particularly advantageous embodiment, the shaft is alternatively hollow all the way through and during manufacture, constitutes a conduit through which the plastic compound, which is injected into the inside of the bristle supporting section in order to produce the bristles, can flow into the region of the cap, preferably into the region of the outer circumference of the cap. This makes it possible in a particularly efficient manner, namely in one work step with the injection molding of the bristles, to achieve a particular embodiment of the cap, preferably in the region of its gripping surface. Typically, this is done to provide the gripping surface of the cap with one or more surface regions that are composed of the softer material of the bristles (compared to the plastic material shared by the cap and the wand section) and to thus improve the haptics of the gripping surface—for example making the gripping surface more non-slip so that it is not as easy for it to accidentally slip out of the hand, for example because the applicator is being guided with fingers that are still wet/damp after showering.

It has turned out to be particularly advantageous if the outer diameter AS of the wand section is essentially or continuously greater than the outer diameter AB of the bristle-supporting section. In this case, the ratio AB/AS is preferably ≤0.8 and ideally ≤0.7. This reliably prevents the bristle set from being overstressed as it passes through the stripper and thus being damaged sooner or later.

An alternative embodiment for attaining the above-stated object is described below:

A cosmetic applicator, particularly in the form of a mascara applicator, has a sealing cap that is provided with a gripping surface and is for tightly closing the cosmetic receptacle. The sealing cap is embodied in the way explained at the beginning. The sealing cap transitions into a shaft protruding from it that ends in a bristle support, which has bristles protruding out from it. By contrast with the embodiment mentioned first, in this embodiment, the bristle-supporting section is embodied in the form of a stabilizing core. It is then encased with a second plastic compound in a second injection molding step so that a sleeve is produced, which encloses the bristle-supporting section, is welded to the entire surface thereof, and at the same time, forms the bristles protruding from its outer surface. According to the invention, the cap and the shaft, which includes the wand section and the bristle-supporting section, are composed of a first plastic material in a one-piece, one-material embodiment, while the sleeve and the bristles protruding out from it as an integral component thereof are composed of a second plastic material, also in a one-piece, one-material embodiment. The whole applicator is thus composed of only a single piece.

Preferably, wherever two different plastics have been mentioned above, the first plastic compound that constitutes the bristles is composed of a plastic that in the chilled state, is more flexible and/or has a better "bend recovery capacity" than the plastic of which the second plastic compound is composed, which preferably constitutes the cap and/or the shaft. A plastic that is particularly well-suited for producing the first plastic compound is the plastic type that is marketed under the brand name "Grilflex"®. Polypropylene (PP) is particularly well-suited for the second plastic compound.

This applicator is also very efficient to produce because it is composed of a single piece, including the bristles.

Such an applicator also has significantly improved properties from a hygiene standpoint. There is no gap between the wand and the coupling piece of a support that is equipped with the bristles. In addition, there are no serious gaps in the region of the bristle set because the sleeve equipped with the bristles and its stabilizing core are in fact welded to each other over their entire surface.

In a preferred exemplary embodiment, in this second equipping alternative just like in the first, the end of the wand section oriented away from the handle is solid and thus constitutes a dividing section that represents approximately ⅕ to ½ of the total length of the wand section. The mold, which is placed around the stabilizing core in a second injection molding step in order to encase this core with the second plastic compound that forms the sleeve from which the bristles protrude, can be pressed against this solid wand section with the pressure required to produce a reliable seal.

Another alternative embodiment for attaining the above-stated object is described below:

The cosmetic applicator, which is in particular embodied in the form of a mascara applicator, includes a sealing cap that forms a gripping surface and that is embodied in the way described at the beginning. The sealing cap transitions integrally into a shaft protruding outward from it, which in turn integrally comprises a wand section and a bristle-supporting section. In this case, the bristle-supporting section transitions integrally into bristles protruding outward from it and the whole cosmetic applicator has been injection molded in a single work step.

In the context of this alternative embodiment, the expression "injection molding in a single step" is understood to include any type of manufacture that can take place inside one and the same injection mold, without first injection molding a blank that is then entirely or partially removed from the mold in order to continue the injection molding process in another mold device.

At first, the requirement for the cosmetic applicator to be injection molded in one work step might look like a method feature that is actually irrelevant for a device claim. In this case, however, this supposed method feature constitutes an indirect property specification that stipulates a particular property for the bristles: specifically in the region of the bristles, it is of fundamental importance that in the course of being shot into the bristle-forming cavities, the plastic chains disentangle and are aligned in a direction parallel to the longitudinal axis of the respective bristle. Only then do the bristles exhibit a good bend recovery capacity similar to that of the well-known bristles, which are cut from filaments that are extruded and possibly then stretched and conventionally held between twisted wires in order to thus obtain a set of bristles. The injection molding causes an alignment of the polymer chains to occur specifically in the region of the bristles, which is why injection molded bristles clearly differ physically and in terms of their use properties from bristles that have been produced, for example, using the "rapid prototyping" method.

If one approaches the idea of injection molding a whole applicator in one step or with one shot, then the initial expectation is for there to be significant problems since it is necessary to produce relatively coarse structures (cap, plate, wand) and extremely fine structures at the same time. It has surprisingly turned out that with the inherently delicate injection molding of the cap, wand, and bristles, unexpectedly good results are achieved if an injection pressure is used that is significantly higher than the injection pressure customarily used for the injection molding of fine bristles, for example at least 900 bar or better still, at least 1200 bar. With this approach, it is apparently possible to compensate for the fact that when injection molding a whole applicator in one piece, the plastic compound that is injected into the comparatively large-volume mold cavity must travel longer distances therein before it can travel into the bristle-forming mold cavities and is then already cooled too much to still be able to form bristles therein that have truly good mechanical properties.

It should be noted that it is particularly advantageous if the outer diameter of the wand section is essentially or continuously greater than the outer diameter AB of the bristle-supporting section. In this case, the ratio AB/AS is preferably ≤0.8 and ideally ≤0.7.

At the transition to the bristle-supporting section, the outer diameter of the wand section advantageously decreases relative to the outer diameter of the wand section elsewhere.

For each of the three alternative embodiments mentioned above, it is advantageous to provide the sealing cap with one or more holding projections, which is/are embodied so that in cooperation with one or more holding projections provided on the receptacle, it/they produce(s) a quick acting closure for the applicator, which closure is embodied as a bayonet closure or preferably as a multi-start short thread and is laid out so that with a rotating movement ≤⅜ of a turn and better still, with a rotating movement ≤¼ of a turn, the holding elements can be moved from a completely closed position into a position in which they are no longer attached to each other in a direction along the longitudinal axis of the applicator.

Preferably, the short thread provided as a wand thread is embodied with a pitch angle μ of preferably greater than 5°. With the aid of such a short thread, despite the fact that the thread is only turned a short distance in the closing direction until it has reached its closed position, a reliably sufficient sealing pressure can be produced between the applicator and the cosmetic receptacle with which it is associated (in the direction parallel to the longitudinal axis of the applicator).

In all three embodiments, it has turned out to be advantageous if the plate has an opening, which connects the cavity of the wand section to the adjacent cavity that is encompassed in the circumference direction by the cap. This is because a wand that is solid all the way through has turned out to be disadvantageous due to the high consumption of material and the long cooling times.

Other possible embodiments, operating methods, and advantages ensue from the following description of exemplary embodiments based on the figures.

BRIEF DESCRIPTION OF THE DRAWINGS

FIG. 9 is a detail view that in principle corresponds to the view in FIG. 7, but in which the section plane is rotated by 90° around the longitudinal axis L.

FIG. 10 is a view from above.

DETAILED DESCRIPTION OF THE PREFERRED EMBODIMENTS

FIGS. 1 through 10 show a first exemplary embodiment of the invention in the form of a cosmetic or mascara package, whose sealing cap 2 is connected to the receptacle 7 by means of a so-called click-and-close closure.

Figure 1:
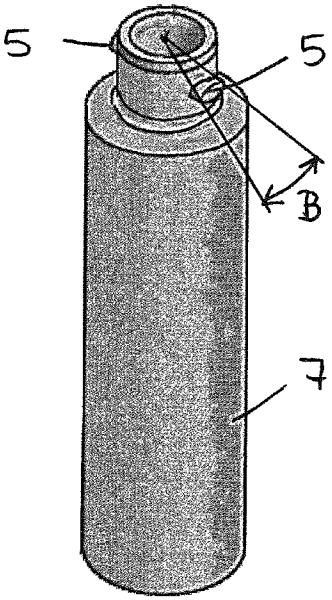
FIG. 1 shows a receptacle with holding projections according to the invention, according to a first exemplary embodiment.

As shown in FIG. 1, such a click-and-close closure includes a plurality of holding projections 5 on the receptacle. The holding projections 5 protrude radially outward from the receptacle neck and have only a locally limited span, whose radian measure B is preferably less than 1/10 and ideally less than 1/15 of a full circle. In this exemplary embodiment, the holding projections 5 on the receptacle do not have a thread pitch. But they are preferably at least partially round or convex at least on the side on which they interact with the corresponding holding projections of the sealing cap. This facilitates engagement and disengagement.

Figure 2:
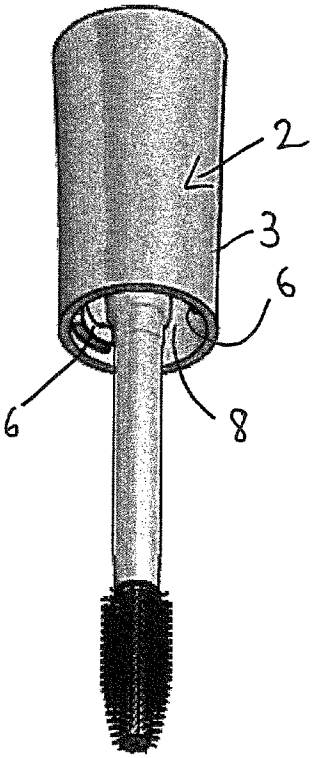
FIG. 2 shows the cosmetic applicator from FIG. 1 with a sealing cap that has corresponding holding projections.

As shown in FIG. 2, the sealing cap 2, which as a rule has a gripping surface on its outside, is partially composed of a tubular cap body 3 that surrounds, i.e. circumferentially encompasses, an inner space 8 while at the end surface, there is an open cross-section. As is clearly shown in FIG. 2, the tubular cap body 3, on its inside, has two holding projections 6 on the sealing cap, which constitute another component of the click-and-close closure. The holding projections 6 are attached a suitable distance from the lower edge of the cap body so that the lower edge of the cap body constitutes a skirt, which essentially blocks the direct view of the holding projections.

The holding projections 6 on the sealing cap protrude radially inward into the inner space 8 enclosed by the cap body 3. In a way similar to the holding projections 5 on the receptacle, the holding projections 6 on the sealing cap have only a locally limited span, whose radian measure is preferably less than 1/10 and ideally less than 1/15 of a full circle. In this exemplary embodiment as well, the holding projections 6 on the sealing cap do not have a thread pitch.

Figure 3:
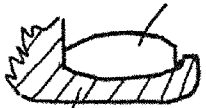

In this exemplary embodiment, the holding projections 5 and 6 are matched to each other so that each of the holding projections 6 on the sealing cap engages under the holding projection 5 on the receptacle currently associated with it and preferably engages with it in a form-fitting way as soon as the closed position is fully achieved, see FIG. 3, which illustrates the above-mentioned principle.

Figure 4:
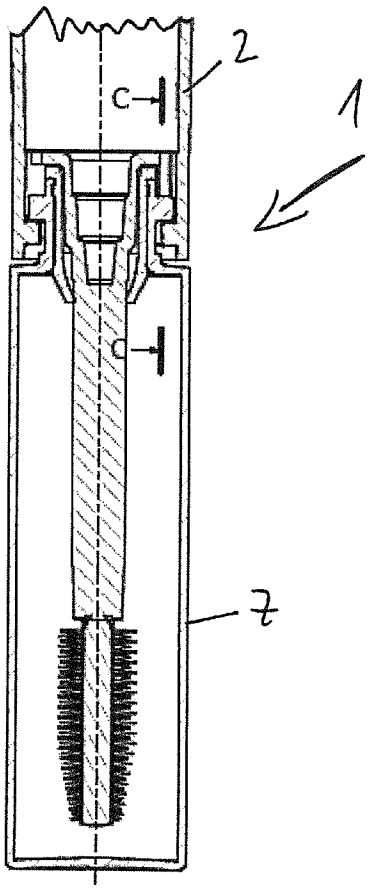
FIGS. 3 and 4 show how the holding projections of the receptacle and of the sealing cap cooperate in a form-fitting way.

In this way, the cooperation of the receptacle neck with the sealing cap shown in FIG. 4 produces the so-called click-and-close closure.

Figure 5:
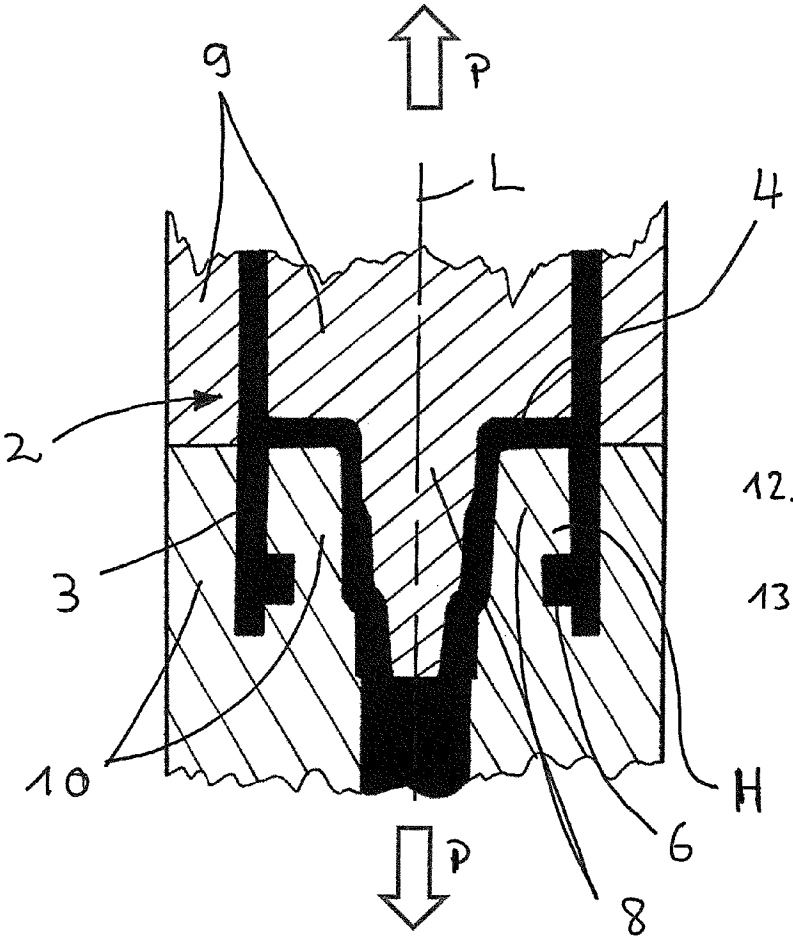
FIG. 5 shows the production of a sealing cap in a conventional injection mold of the kind known in the prior art.

FIG. 5 shows the problem that arises when attempting the one-piece manufacture of such a sealing cap 2 for such a click-and-close closure using the means of the prior art instead of manufacturing it out of two individual parts to be subsequently assembled.

The one-piece sealing cap 2 with its tubular cap body 3 is shown with a continuous black color and is thus clearly visible. The inner space 8 of the sealing cap enclosed by the tubular cap body 3 is divided by a plate 4 into two sections that are separate from each other. The plate 4 is used for fastening the wand or shaft, not shown, or even transitions integrally into it.

The injection mold to be used for the one-piece manufacture is composed of a first mold half 9 and a second mold half 10, as indicated by the different cross hatchings. To remove the injection molded part after it has cooled sufficiently, the two mold halves must be moved away from each other in the direction of the arrows P, parallel to the longitudinal axis L of the sealing cap. In this case, the problem arises that the projections 6 on the sealing cap form an undercut H, which makes it impossible to remove the sealing cap from the second mold half 10, see FIG. 5.

Figure 6:
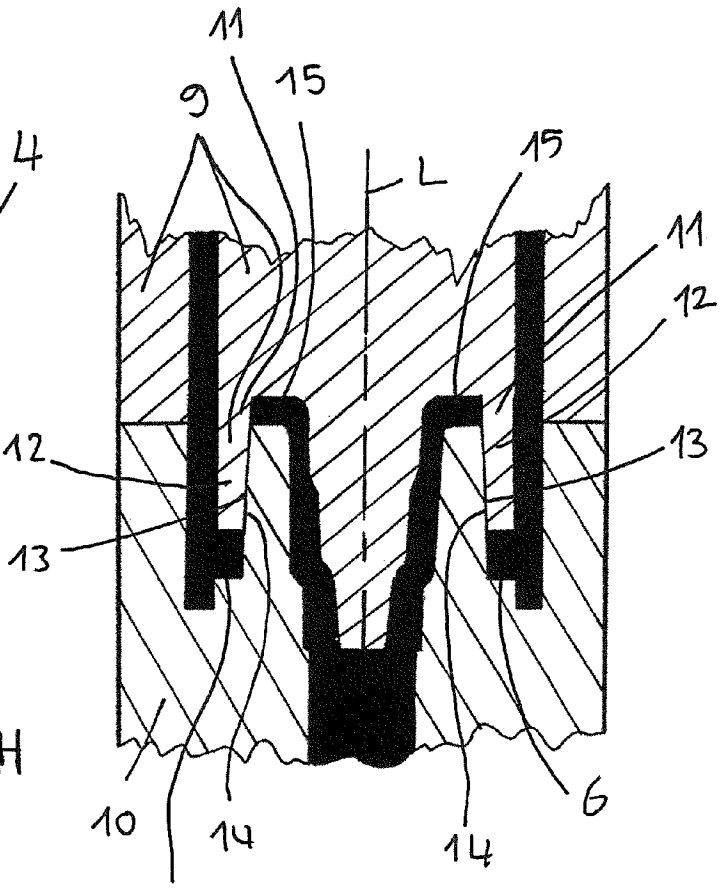
FIG. 6 shows the production of a sealing cap in an injection mold according to the invention.

FIG. 6 shows how this problem is solved according to the invention.

For each holding projection 6, the plate has a window 11 that is aligned with the associated holding projection 6, viewed in the direction of the longitudinal axis L of the sealing cap. The free cross-sectional area of the window 11 in the direction of the longitudinal axis L is at least as large as the projected area of the holding projection with which it is associated, viewed in the direction of the longitudinal axis L. In the present case, the free cross-sectional area of the window 11 is also larger for the reasons to be explained in greater detail below.

At this point, it should be noted that each of the windows 11 actually has only a locally limited span in both the radial and circumferential directions so that wherever there is no window 11, the plate 4 is integrally joined to the cap body 3.

As is clear from FIG. 6, the windows 11 make it possible to provide the first mold part 9 with tongues 12 that each extend through the associated window 11 and at least fill the space that cannot be filled by the second mold part 10 if one is to avoid producing an undercut H—due to the presence of the holding projections—that makes it impossible to remove the finished injection molded sealing cap from the second mold part 10.

Upon closer inspection of FIG. 6, it is also clear why the free cross-sectional area of each window 11 in the present case is greater than the projected area of the holding projection 6 with which it is associated—it is especially advantageous to embody the tongues 12 of the first mold half 9 as conical or wedge-like, at least on their surface 13 oriented radially inward, since this makes it possible to achieve a particularly reliable sealing pressure with the correspondingly shaped counterpart surfaces 14 of the second mold half 10.

For the same reason, it is particularly advantageous (even if not absolutely required) to also embody the side surfaces of each tongue oriented in the circumference direction as conical or wedge-like.

It is clear that as a result, the free cross-sectional area of the windows 11 is greater than the projected area of the holding projections 6 at least in the radial direction, while ideally, it is in fact greater than the projected area of the holding projections 6 in both the radial and circumference directions.

It is also important for the window 11 not to extend too far in the radially inward direction so that despite the presence of the window or windows, an uninterrupted sealing section 15 remains that is completely closed in the circumference direction. This sealing section 15 can be pressed against a corresponding counterpart surface on the neck of the cosmetic receptacle or on the collar of the stripper that overlaps the neck, and thus tightly seals the cosmetic receptacle.

Preferably, this sealing section 15 is embodied in the form of a closed annular disk that is situated between the shaft lug of the plate 4 and the projection of the holding projections 6, in a plane or set of planes extending orthogonal to the longitudinal axis (L) of the sealing cap.

Figure 7:
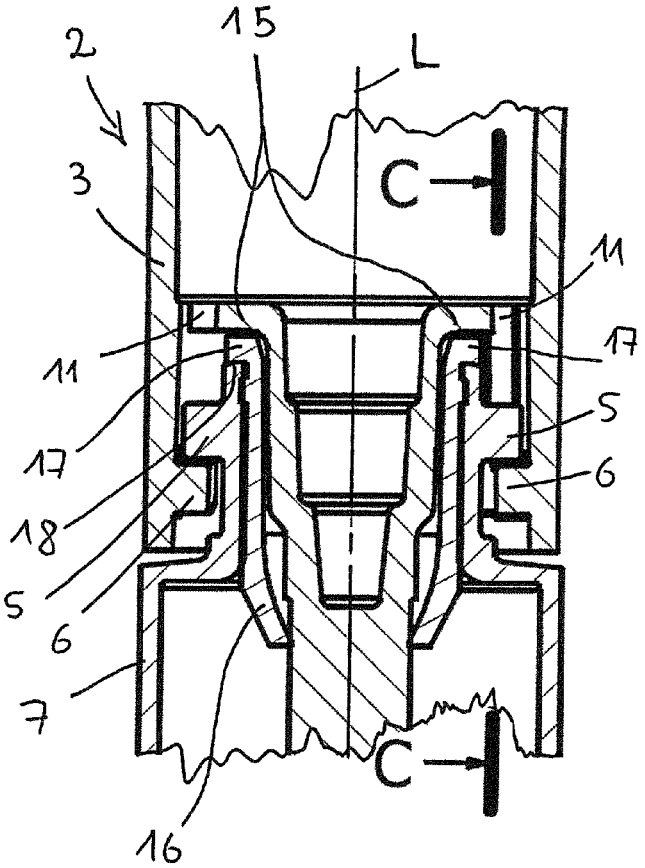
FIG. 7 is a detail view showing how the holding projections cooperate.
Figure 8:
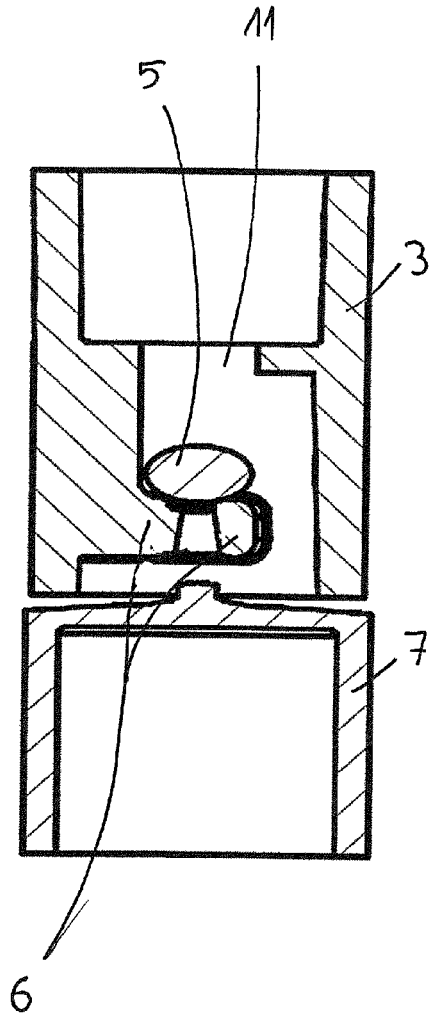
FIG. 8 is a side view along the section labeled C-C in FIG. 7.

Based on the above explanations of FIGS. 5 and 6, it is therefore easy to understand what is disclosed in FIGS. 7 and 8.

FIG. 7 shows a section through the receptacle 7, which is equipped with a stripper 16 and on which, with the aid of a click-and-close closure, a sealing cap 2 is fastened, which cap transitions integrally into a shaft or shaft lug.

The drawing clearly shows the holding projections 5 and 6, which engage behind each other in a form-fitting way and thus press the remaining sealing section 15 on the plate 11 snugly against the collar 17 of the stripper 16 that extends beyond the end surface 18 of the receptacle neck.

The drawing also clearly shows the windows 11, two of which are preferably provided on diametrically opposing sides.

FIG. 8 shows what one sees when looking from the right side at the section along the line C-C in FIG. 7.

This drawing shows even more clearly the interplay of a holding projection 5 on the receptacle with a holding projection 6 on the sealing cap. The drawing also shows how the holding projection 6 on the sealing cap forms a detent recess into which the convex contact surface of the holding projection 5 on the receptacle snugly fits so that a form-fitting detent engagement is produced.

The drawing also clearly shows the window 11 associated with the holding projection 6 on the sealing cap.

FIG. 9 also shows a section through the receptacle 7 equipped with a stripper 16 shown in FIG. 7, to which a sealing cap 2 is fastened with the aid of a click-and-close closure. The intersecting plane, however, is rotated by 90° around the longitudinal axis (L) in comparison to the intersecting plane shown in FIG. 7.

In this case, the drawing clearly shows the uninterrupted plate 4, which has no windows in this region.

FIG. 10 shows a view from above into the sealing cap shown in FIG. 7. The drawing clearly shows the two windows 11 through which each of the aligned holding projections 6 on the sealing cap is respectively visible, whose projected areas are each respectively smaller than the free cross-sectional area of the relevant window 11.

Figure 11:
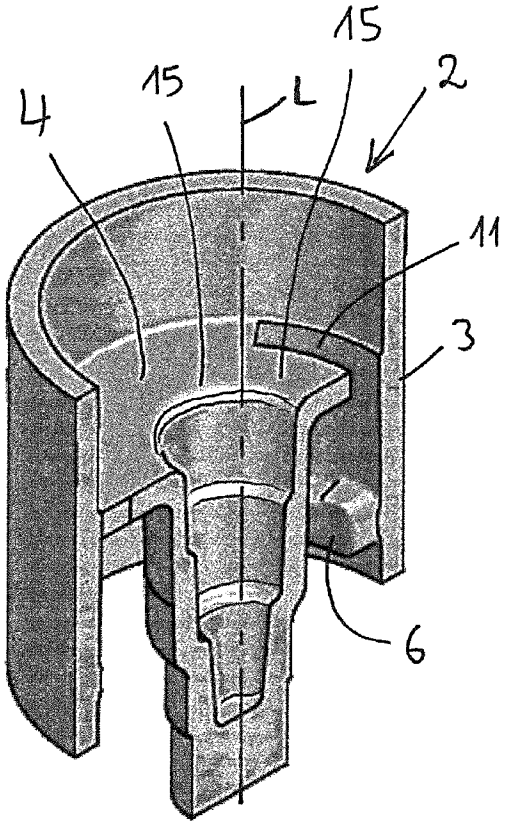
FIG. 11 is a perspective, sectional view of the sealing cap that has already been shown in FIGS. 7 and 9.

Finally, FIG. 11 shows a perspective view of the sealing cap according to the invention.

In this case, the drawing clearly shows the one of the preferably two windows 11 and its alignment with the holding section 6 situated beneath it in the direction of the longitudinal axis (L), while the other window has been eliminated by the section. The drawing also clearly shows the sealing section 15 and the fact that the plate 4 is uninterrupted, i.e. not interrupted by a window, across other regions.

Figure 12:
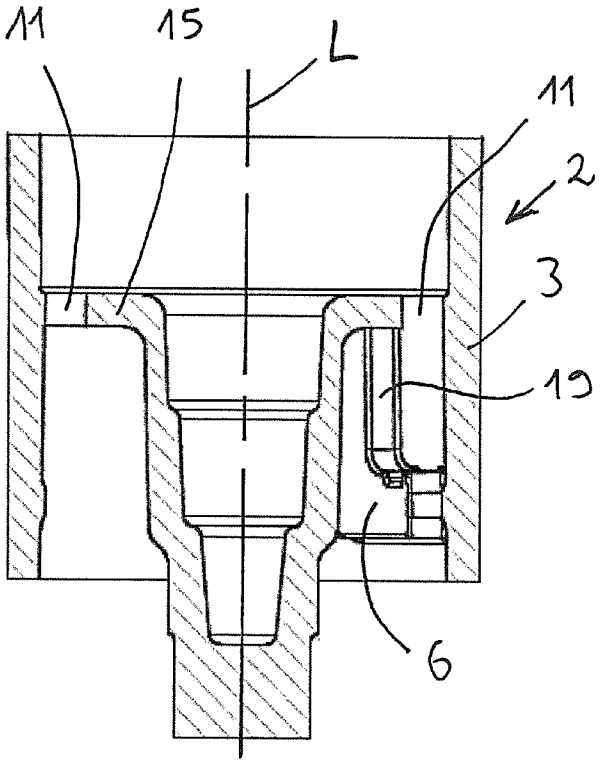
FIG. 12 is a side view of the sectional surface from FIG. 11.

In principle, FIG. 12 shows the same thing as FIG. 11, but in a flat view from the side.

The preferred embodiment of the holding projections 6 on the sealing cap are shown with particular clarity here. Unlike the holding projections 5 on the receptacle, the holding projections 6 on the sealing cap are preferably not embodied as wings that are completely free on all sides and are only attached on a single side. Instead, the holding projections 6 on the sealing cap preferably transition on their one side into a stop 19 for the stop projections on the receptacle, thus preventing an overtightening that would cause the already fastened sealing cap 3 from coming loose again. The stop 19 predetermines a defined closing position of the sealing cap 3 relative to the receptacle 7 so that when in the fully closed position, the sealing cap 3 and the receptacle 7 have a visually attractive appearance, even if they are not round.

Ideally, the holding projections 6 on the sealing cap essentially form the shape of an L that is bonded with its one side flank to the inner surface of the sealing cap 3, with its one leg constituting the actual holding projection that engages beneath the holding projection 5 of the receptacle and with its other leg constituting the above-mentioned stop projection 19.

Figure 13:
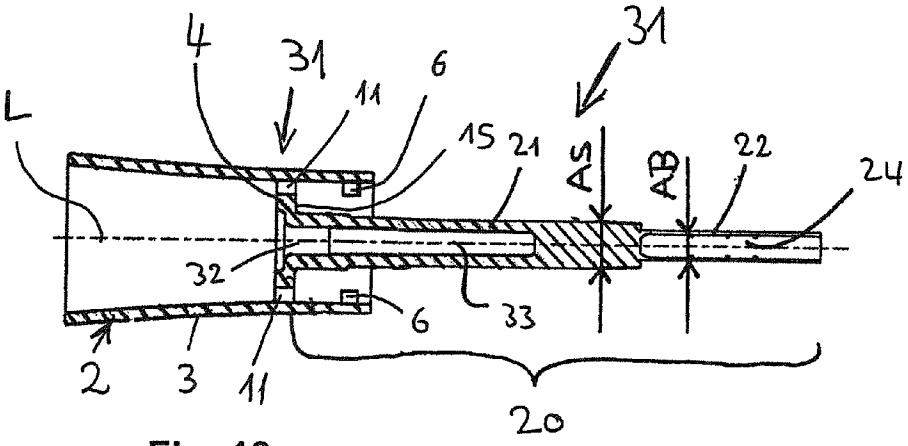
FIG. 13 shows a first exemplary embodiment of a one-piece applicator, which has been produced with the aid of the sealing cap according to the invention, before the injection molding of the bristle set.
Figure 14:
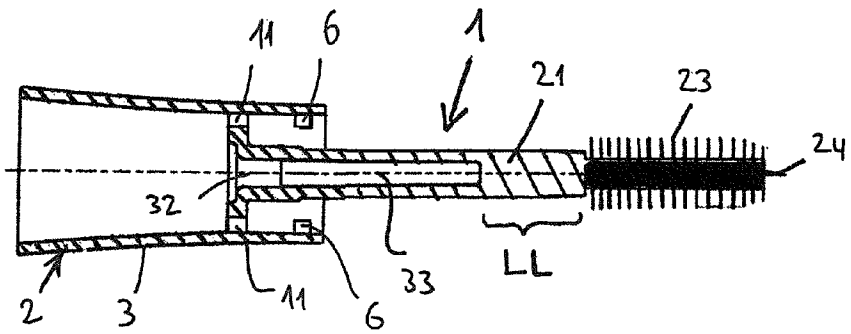
FIG. 14 shows the first exemplary embodiment from FIG. 13 when completed.
Figure 16:
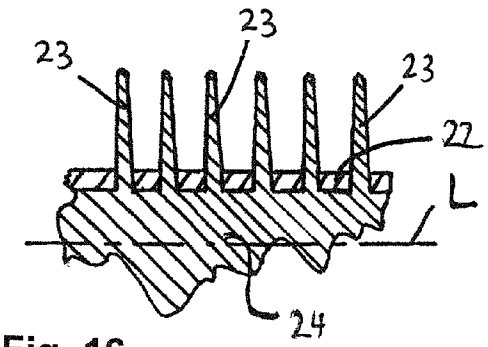
FIG. 16 is an enlarged detail view of the applicator shown in FIG. 14, in the region of the bristle-supporting section 22.

FIGS. 13 and 14 show a second exemplary embodiment of the invention.

The second exemplary embodiment differs from the first exemplary embodiment in that here, the holding projections on the sealing cap and on the receptacle are each provided with an inclination so that they function in a manner similar to a screw. Apart from this fact, it is functionally identical to the first exemplary embodiment so that statements made regarding the first exemplary embodiment also apply to this second exemplary embodiment, provided that nothing to the contrary is stated below.

Figure 12B:
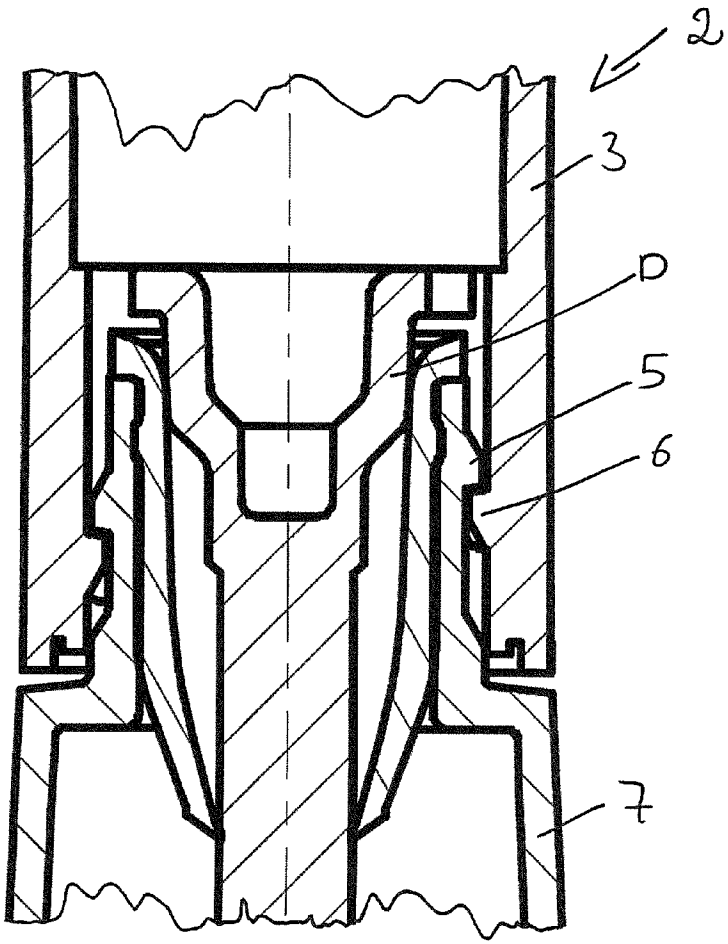
FIG. 12B shows—for the second exemplary embodiment of the invention—how the sealing cap and the receptacle neck cooperate with corresponding holding projections.
Figure 12A:
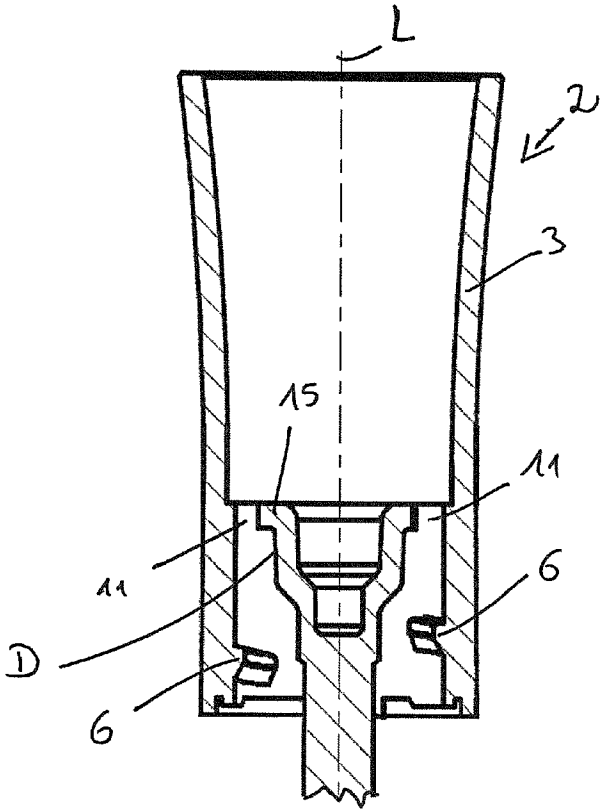
FIG. 12A shows a section along the longitudinal axis L through a second exemplary embodiment of the invention.

FIGS. 12A and 12B show the windows 11 that enable the manufacturing method already described in conjunction with FIG. 6.

It is important that even though they have an inclination, the holding projections each extend over only a small part of the circumference, preferably within the limits that have already been described for the first exemplary embodiment.

The design described in detail above, in which the sealing surface 15 is embodied in the form of an annular disk, which is preferably also implemented in this embodiment as well, can be made smaller or even be eliminated if the plate transitions into a sealing cone D, which the thread action of the holding projections 6 presses firmly into the correspondingly embodied inner circumference of the stripper, as illustrated in FIG. 12B.

The Applicators According to the Invention that can be Efficiently Manufactured Through Involvement of the Sealing Cap According to the Invention The sealing cap according to the invention is ideally suited for use in the construction of one-piece applicators in which the sealing cap, whose plate, the adjoining wand or shaft, and the bristle support including its bristle set are composed of a single piece, which is injection molded in a single step or in two successive steps.

First Applicator Type

First, a description will be provided below in conjunction with FIGS. 13 through 16 for an exemplary embodiment in which the one-piece applicator is manufactured with the aid of a special injection molding method, in the course of which the bristles are manufactured by being shot through the wall of the bristle-supporting section.

The one-piece applicator according to the invention is composed of a sealing cap 2 embodied according to the invention, which is integrally joined to a shaft 20, see FIG. 13. The shaft 20 has a longitudinal axis that is identical to the sealing cap longitudinal axis L and therefore is likewise labeled with the reference letter L. The shaft 20 is in turn divided into two sections with different functions and is integrally composed of a wand section 21 and a bristle-supporting section 22, see FIG. 1. The wand section 21 provides for the sufficient spatial distance between the bristle set and the handle formed by the sealing cap 2, which is required in order to give the applicator the application behavior desired by users. The bristle-supporting section 22 serves to anchor the bristle set that permits application of the cosmetic and is preferably composed of at least 300 bristles, which are only depicted in rudimentary fashion in FIG. 14. The above-mentioned sections are all part of the same injection molded part 31 referred to as the "main component"; in other words, they are embodied together in the form of a one-piece component and in this regard, reference is hereby made to FIG. 13, which shows the main component 31. Such a main component 31 can be manufactured very efficiently. As soon as it has been provided with the bristle set in a subsequent method step, the applicator is complete. No laborious mounting of a brush part onto a wand is required.

As FIGS. 13 and 14 show, the sealing cap 2 is preferably composed of a tube that is open at both ends, which ideally has a diameter that increases in size in the direction toward its end oriented away from the bristle set. In this case, the inside of the end of the sealing cap 2 oriented toward the applicator has holding projections 6; in this exemplary embodiment they do not have an inclination.

In this case, a plate 4 preferably serves as a connecting element between the shaft 20 or its wand section 21 and the sealing cap 2. This plate extends essentially in the radial direction relative to the longitudinal axis L and is embodied in the way already described above. The plate is preferably positioned so that it divides the tubular cap body composing the sealing cap 2 into two sections, with the length of the section oriented toward the applicator preferably representing approximately ⅓ the length of the section oriented away from the applicator. In this case, the plate 11 preferably has a plate opening 32 in the middle. The plate opening 32 permits the plate to be penetrated by a molding core, which ensures that the shaft 20, in the region of its wand section 21, can be embodied as hollow on the inside, and can possibly form a sealing cone for producing a seal relative to the stripper; the corresponding cavity is labeled with the reference numeral 32.

The wand section 21, however, does not absolutely have to be embodied as hollow over its entire length. Instead, it is preferably embodied so that its distal end, i.e. the end oriented away from the sealing cap 2, is embodied as solid. Preferably, the wand section 21 is embodied as solid at least to a length LL (see FIG. 14), which represents at least ⅙, but better still at least ¼ of its total length. This reliably prevents the plastic compound, which is injected in the second step to form the bristles, from breaking through the stop in the wand section, which is still warm with short cycle times, and penetrating in an uncontrolled fashion in the direction of the sealing cap 2.

Ideally, the outer diameter of the wand section 21 decreases in the region of its distal end, i.e. the end oriented away from the sealing cap 2; this is also visible in the figures.

The distal end of the wand section 21 is integrally joined by the bristle-supporting section 22, as is clearly shown in particular by FIG. 13. The bristle-supporting section 22 is a tube that is at first hollow and is composed of the same material as the wand section 21. The wall thickness of the bristle-supporting section 22, however, is as a rule thinner; it is preferably at most 60%, or better still less than 40% of the wall thickness of the wand section 21. At the transition between the wand section 21 and the bristle-supporting section 22, the wall thickness of the bristle-supporting section 22 preferably increases slightly toward the inside, see FIG. 13.

Bristles 23 oriented outward in an essentially radial direction protrude from the bristle-supporting section 22, as schematically depicted in FIG. 14. In reality, the bristle distances are smaller and the number of bristles is significantly greater since as a rule, at least 300 bristles of the type mentioned here are found on the applicator and occasionally, even more than 600 bristles can be provided. The effective diameter of the preferably essentially round bristles in the region of their base is typically in the range between 0.1 mm and 1 mm, preferably in the range between 0.1 mm and 0.4 mm.

The bristles 23 are injection molded bristles, i.e. bristles that have been given their shape by the corresponding cavity of an injection mold into which they have been shot at high pressure, as a rule, which will be discussed in greater detail below. The injection molding according to the invention also gives the bristles their definitive physical use properties because in injection molded bristles that have been manufactured using the method that defines the invention, the polymer chains that constitute the bristles demonstrate a special orientation parallel to the longitudinal axis of the bristle.

Figure 15:
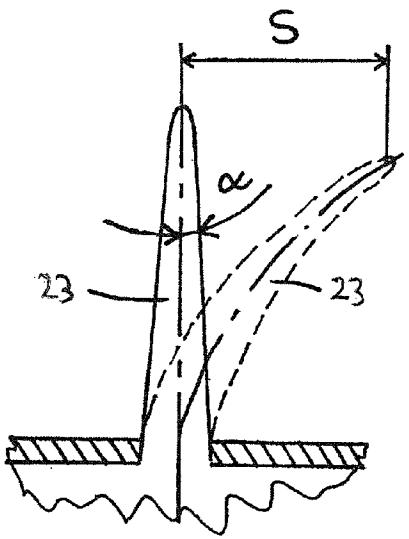
FIG. 15 illustrates what the term "bristle" is understood to mean according to the invention.

The term "bristles" refers preferably to application elements of the kind shown in FIG. 15. Each of these bristles 23 preferably has an essentially conical circumferential surface. Usually, they have a cone angle $\alpha$ of between 0.5° and 2.5°, see FIG. 15. Because of the above-mentioned orientation of the polymer chains, these bristles are as a rule particularly flexible. Consequently, under the influence/upon application of intentionally occurring forces, the bristles can typically be reversibly deflected so that their tip is moved out of the rest position by a distance S that corresponds to at least three times and better still, at least five times the bristle base diameter, without the bristle being permanently deformed.

The bristles 23 are injection molded so that the plastic compound that forms the bristles is injected at a correspondingly high pressure into the cavity 24 of the bristle-supporting section 22. This bristle-forming plastic compound, which is preferably a plastic compound that is different from the one of which the main component 31 has been produced, penetrates the wall of the bristle-supporting section 22 at all of the points at which, viewed in the radial direction, an empty, bristle-forming cavity is situated behind the bristle-supporting wall of the section 22. In this way, it shoots into the above-mentioned cavity. This produces bristles that extend through the wall of the bristle-supporting section 22 and are integrally connected to the solid core that fills the cavity 24 of the bristle-supporting section 22 in a completed brush and are welded to it, see FIGS. 14 and 16. As a result of this, the plastic compound that forms the bristles and the plastic that forms the bristle-supporting section 22 are very intimately joined; there are no microscopically small open joints that could potentially encourage colonization by fungi or bacteria. Ideally, the plastic compound that forms the bristles 23 is composed of a plastic that is more elastic and/or has a lower Shore hardness than the plastic of which the main component 31 of the applicator shown in FIG. 1 is composed.

Figures 17, 18, 19:
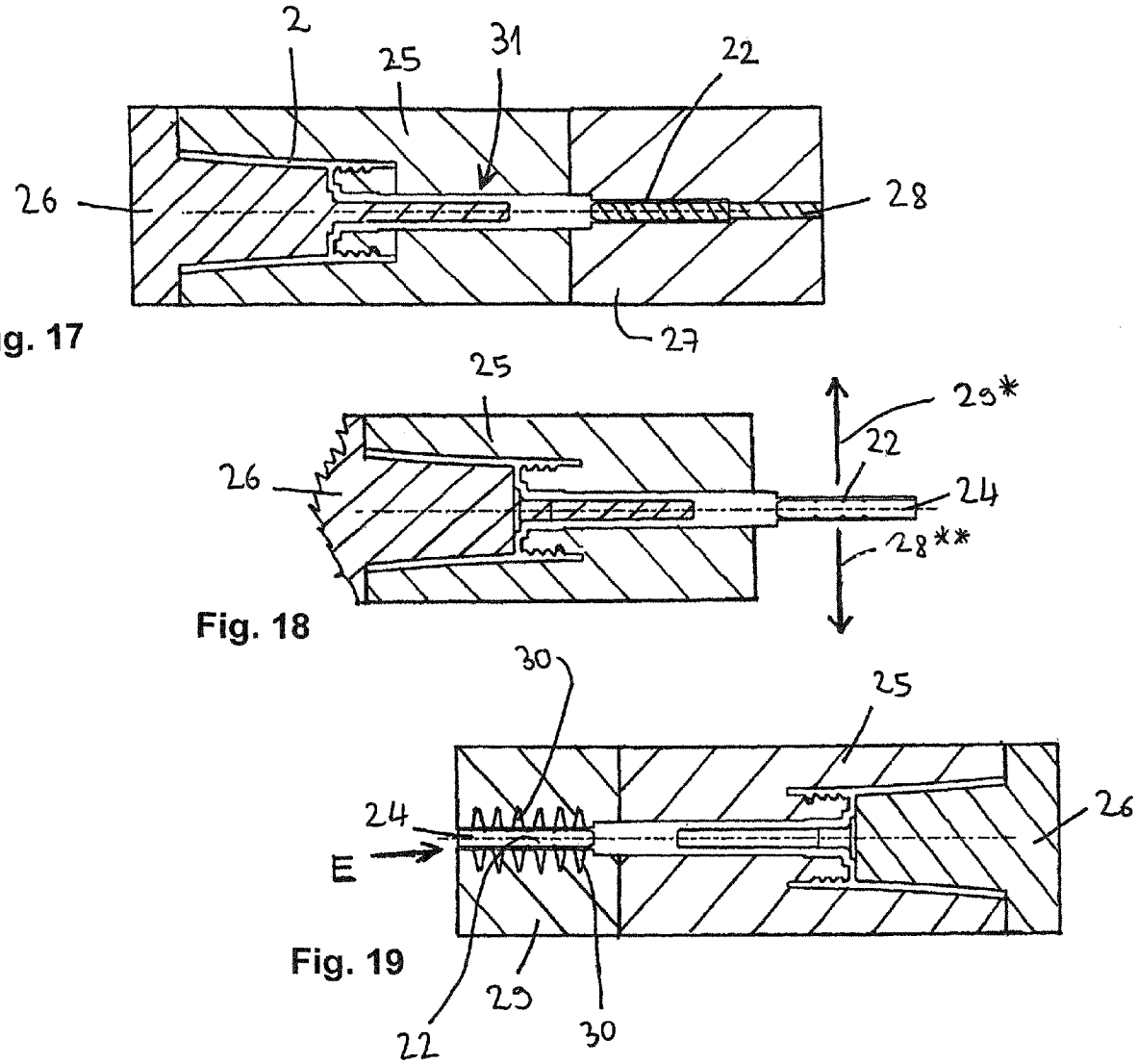
FIG. 17 shows how the main component of the exemplary embodiment described in FIGS. 13 and 14 is produced.
FIG. 18 shows, for the main component shown in FIG. 17, how the component is partly removed from the mold in order for the bristle set to be injection molded in the next step.
FIG. 19 likewise shows the main component shown in FIG. 17, but after it has been inserted into a mold that permits the injection molding of the bristle set in the next step.

The sequence of the manufacturing method for the applicator according to the invention can best be seen in FIGS. 17, 18, and 19.

In a first method step, the main component 31 is injection molded as a one-piece component; the injection molding of the sealing cap 2 is carried out as described in the beginning in conjunction with FIG. 6, which is not, however, graphically depicted in FIGS. 17 through 19. Preferably, the multi-part mold shown in FIG. 17 is used for this purpose. The mold is composed of the main mold part 25 and the first slider 26, which embodies the windows 11 in the way shown in FIG. 6. The mold is also composed of the first mold end piece 27 for forming the bristle-supporting section 22 and the second slider 28 provided for the same purpose. The second slider 28 is guided in a sealed fashion in the first mold end piece 27. It is worth noting that the parting line between the main mold part 25 and the first mold end piece 27 preferably lies in a plane that intersects the part of the wand section 21 that is solid. It is thus possible to ensure a particularly good seal. The plastic compound that forms the main component is injected into this mold, preferably from the end at which the first slider 26 is located.

As soon as this plastic compound has sufficiently cooled, preferably the second slider 28 is withdrawn first and then the first mold end piece 27 is removed, see FIG. 18. The first mold end piece 27 is ideally composed of multiple parts so that the individual components of the mold end piece 27 can be pulled apart from one another in different directions, as schematically indicated by the arrows 29* and 28**. The main component is preferably not removed further from the mold at this stage of the method; in other words, the other components of the mold remain in their positions relative to one another.

Preferably, the components of the injection mold, which at this point still contain the main component, are turned in order to bring the bristle-supporting section 22 to the side of the injection point in order to subsequently be able to connect the mold encompassing it to the injection point.

The region of the main component that is freed by the removal of the first mold end piece 27 is then inserted into a second mold end piece 29, as shown in FIG. 19. This second mold end piece 29 is preferably likewise composed of a plurality of components that can be moved in the radial direction relative to one another into place against the main component and can also be lifted away from the latter again. The key factor is that this second mold end piece 29 is equipped with cavities 30 for forming the bristles, as depicted in very schematic fashion in FIG. 19.

These cavities 30 are empty at first and their mouths are initially covered by the wall of the bristle-supporting section 22. In a next step, the bristle-forming plastic compound is injected from the side of the arrow E into the cavity 24 of the bristle-supporting section 22. The plastic compound exerts a powerful pressure against the wall of the bristle-supporting section 22 from the inside so that ultimately, the plastic compound breaks through the wall of the bristle-supporting section 22 wherever the wall is covering the mouth of a bristle-forming cavity 30. In this way, the plastic compound shoots into the bristle-forming cavities. Once this has happened, a pause occurs until this second plastic compound has hardened enough to retain its shape. Then the finished applicator is completely removed from the mold.

In this exemplary embodiment, the second mold end piece 29 is segmented like pieces of cake so that the individual parts of the mold end piece 29 can be moved away from one another in the radial direction in order to thus be able to remove the bristles from the mold without tearing them. Then the first slider 26, which is embodied according to FIG. 6 and contrary to the depiction in FIGS. 17 through 19, is withdrawn. Finally, the completed applicator is ejected from the main mold part, which occurs with no trouble thanks to the embodiment of the holding projections explained at the beginning.

The key point is that this method produces a completely finished applicator in one cycle, without having to remove individual components from the injection molding unit and convey them to another station in order to assemble them there.

Figure 20:
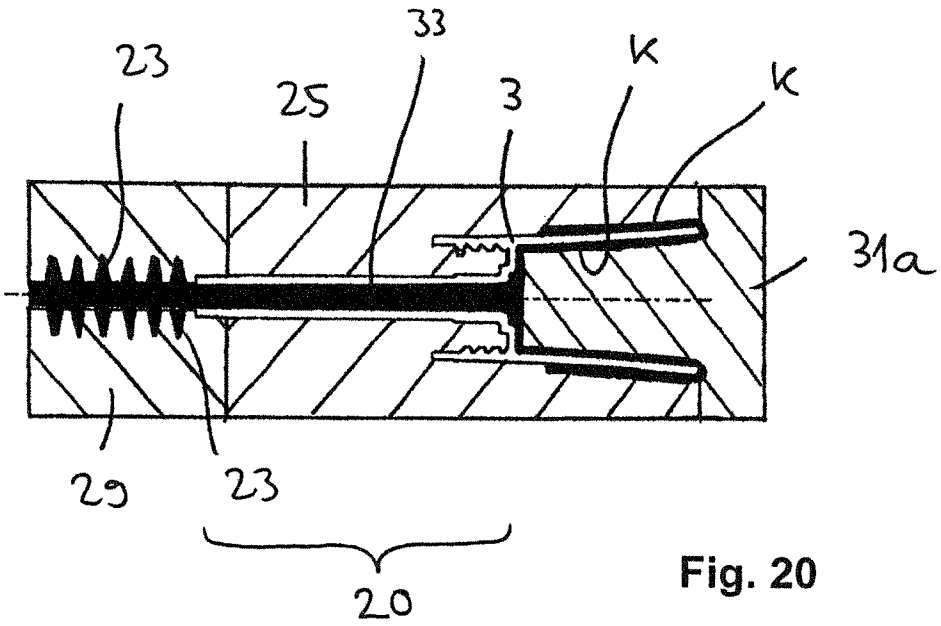
FIG. 20 shows a second exemplary embodiment of a one-piece applicator, which can be beneficially produced with the aid of the sealing cap according to the invention.

FIG. 20 shows another exemplary embodiment of the invention.

This exemplary embodiment corresponds in its entirety to the first exemplary embodiment described in detail above so that statements made regarding the first exemplary embodiment also apply to this second exemplary embodiment, provided that nothing to the contrary is indicated by the differences described below.

The second exemplary embodiment features the fact that in it, the shaft 20 is hollow inside along its entire length. Unlike the first exemplary embodiment, the second exemplary embodiment therefore has no dividing section that is embodied as solid.

Otherwise, as shown by FIG. 20, in this exemplary embodiment as well, the sealing cap 2 is embodied in the same way as explained at the beginning.

The elimination of the solid dividing section makes it possible to provide a conduit through which the second plastic compound K, which is injected in order to form the bristles, flows through the shaft 20 into the region of the sealing cap 2. Preferably, the second plastic compound K also flows into the region of the outer circumference of the sealing cap and for example forms a gripping surface that is especially haptically and/or visually attractive.

This makes it possible in a particularly efficient manner, namely in one work step with the injection molding of the bristles, to produce a particularly advantageous gripping surface on the sealing cap 2. In this case, care must absolutely be taken that the slider 31—which is inserted instead of the first slider 26 in order to carry out the second injection molding step in which the bristles are produced—covers the windows 11 so that the second plastic compound cannot penetrate into the region of the undercut that is opened up upon withdrawal of the first slider 26, also see FIG. 6.

Second Applicator Type

The above-described one-piece applicator and the above-described "two-shot" injection molding method for manufacturing an applicator that is composed of one piece overall are not the only possibility for the beneficial use of the sealing cap explained at the beginning.

On the contrary, there is alternatively also the possibility of a modified two-shot injection molding method that is carried out in the sequence explained below and that produces a corresponding applicator. Since the above-described applicator and the modified applicator described below only differ in details relating to their bristle sets, statements made with regard to the above-described exemplary embodiment also apply to the additional exemplary embodiment, provided that nothing to the contrary is indicated by the differences described below.

Figure 21:
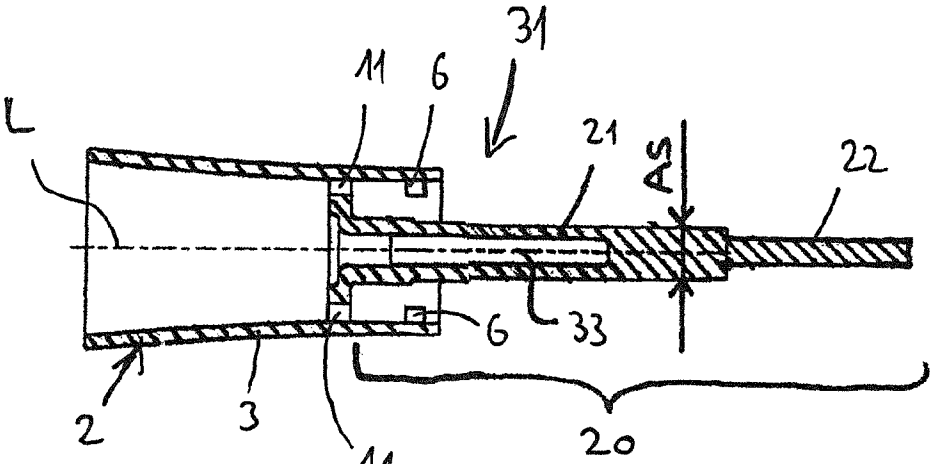
FIG. 21 shows a main component of a third exemplary embodiment of a one-piece applicator, which can be beneficially produced with the aid of the sealing cap according to the invention.

Once again, the main component 31 shown in FIG. 21 is injection molded first, which constitutes the functional sections mentioned above, including the sealing cap embodied according to the invention shown in FIG. 6. The bristle-supporting section 22, however, is now as a rule embodied in the form of a solid rod, which serves to anchor and as a rule also to stabilize the bristle set that is to be produced in the next work step and that enables the application of the cosmetic.

In this case, care is taken that the main component 31 has a sufficient jump in diameter between its bristle-supporting section 22 and its wand section 21. As a rule of thumb, the diameter of the bristle-supporting section should be less than 0.5 times the diameter of the wand section before the injection molding of the bristles.

Figure 22:
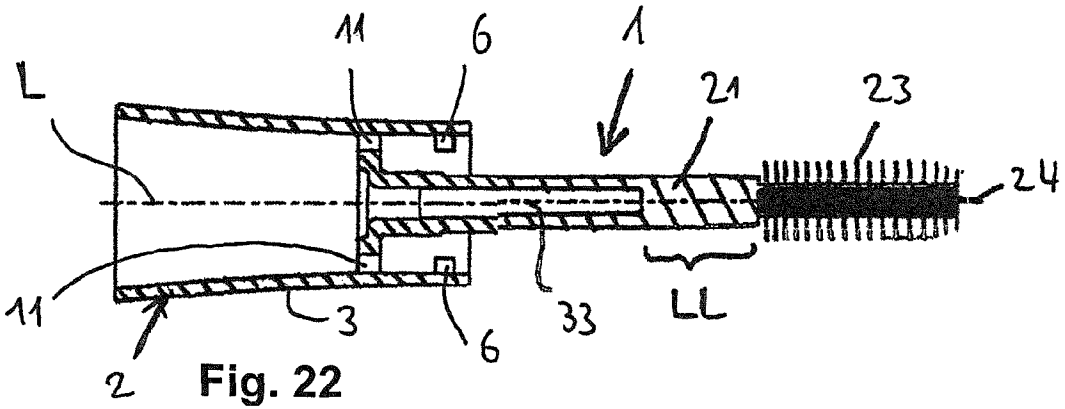
FIG. 22 shows the third exemplary embodiment of the above-mentioned one-piece applicator when complete.

In the finished applicator, the bristle-supporting section 22 is preferably enclosed by a sleeve composed of plastic that is injection molded onto it and welded to its entire surface—i.e. the plastic that forms the bristles. Consequently, bristles 32 that are oriented outward in an essentially radial direction protrude from the finished applicator, as schematically depicted in FIG. 22. In reality, the bristle distances are also smaller, the number of bristles is significantly greater, and the statements made above in this regard also apply.

The bristles 23 are injection molded bristles, in other words bristles that have been given their shape by the corresponding cavity of an injection mold into which they have been shot at high pressure, as a rule, which will be discussed in greater detail below. The injection molding according to the invention also gives the bristles their definitive use properties because in injection molded bristles that have been manufactured using the method that defines the invention, the polymer chains that constitute the bristles demonstrate a special orientation parallel to the longitudinal axis of the bristle. As a rule, this requires the bristles to be injection molded using a correspondingly high injection pressure. Preferably, the injection pressure is ≥900 bar. In this case, each of the bristle-forming cavities is ventilated, preferably at several points, to be specific, ideally not only at the end of the bristle-forming conduit, but also between the beginning and end of each bristle-forming conduit.

Figure 23:
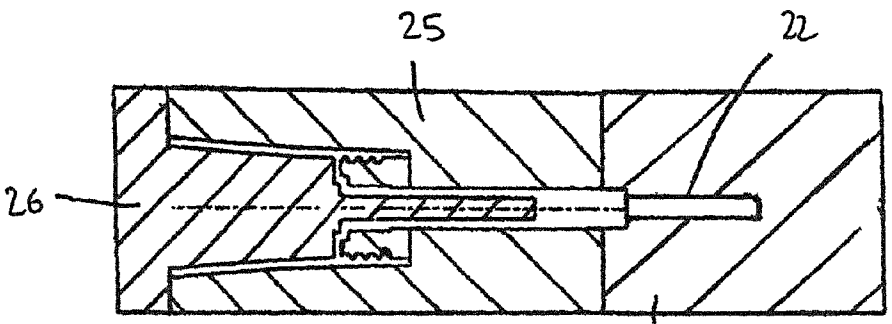
FIG. 23 shows the mold device in which the main component of the third exemplary embodiment shown in FIG. 21 is injection molded.
Figure 24:
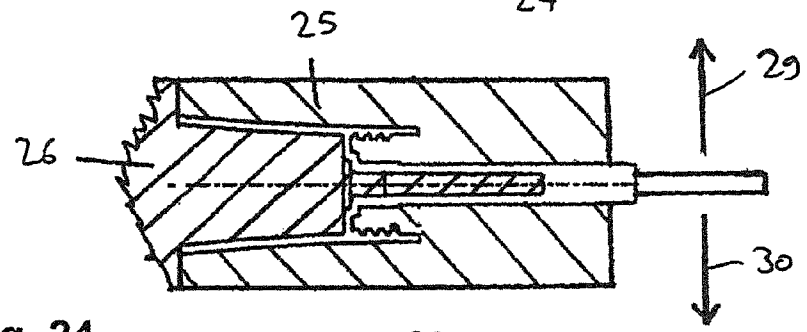
FIG. 24 shows how the main component injection molded with the aid of the ensemble in FIG. 23 is partially removed from the mold so as to be able to bring into position a mold that enables the injection molding of the bristle set.
Figure 25:
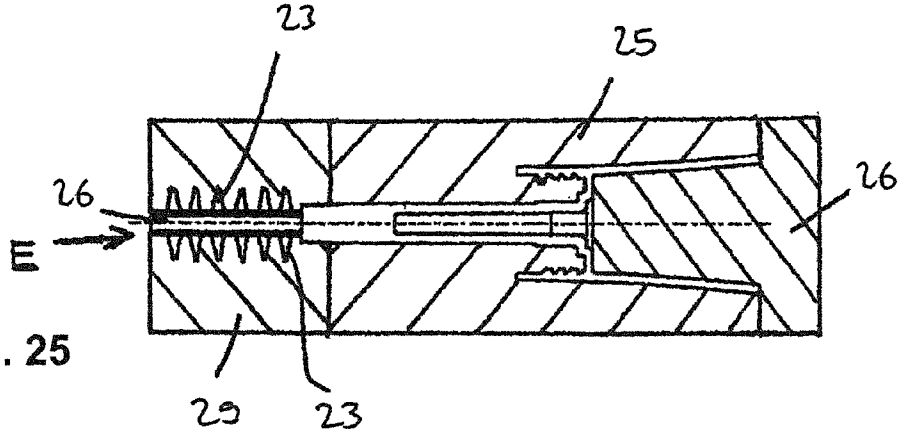
FIG. 25 shows the main component shown in FIG. 23 at the moment when the part of the mold that enables the injection molding of the bristle set has been brought into position.

The manufacturing method described above for the first applicator type is used to manufacture this second one-piece applicator type, but using a first mold end piece 27, which as a rule does not have a slider, and a modified mold end piece 29. In this regard, reference is hereby made to FIGS. 23 through 25, which show the difference. In the region of the bristle-supporting section 22 of the main component 31, the second mold end piece has a main mold cavity with a somewhat larger inner diameter than the bristle-supporting section 22 of the main component. The bristle-forming cavities extend out from this main mold cavity in the radial direction. In this way, the injection of the second plastic compound on the outside of the bristle-supporting section produces a coating of the bristle-supporting section directly by the bristles 23, without first having to break through a wall of the bristle-supporting section 22.

Third Applicator Type

Finally, there is also a third possibility for manufacturing a novel applicator using the sealing cap according to the invention.

This applicator is continuously composed of a single plastic material, from the sealing cap to the bristles.

Figure 26:
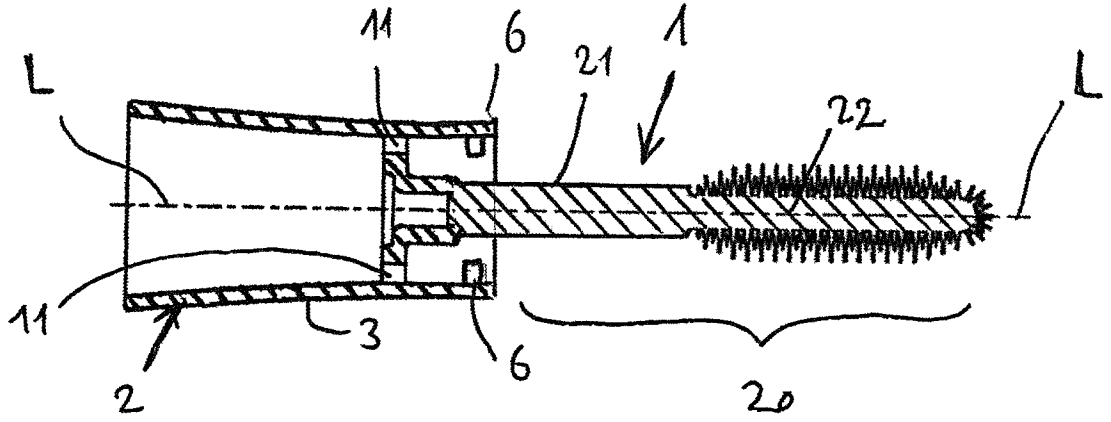
FIG. 26 shows a fourth exemplary embodiment of an applicator that is produced in one piece and of one material, using the sealing cap according to the invention.

In this regard, reference is hereby made to FIG. 26. The applicator has a sealing cap 2 that is embodied in the way described at the beginning and transitions integrally into a shaft 20. The shaft 20 is in turn integrally composed of the shaft section 21 and the bristle-supporting section 22 likewise integrally joined thereto, see FIG. 26. The bristle-supporting section 22, the bristles 23, the wand section 21, the plate 11, and the sealing cap 2 have been injection molded together "in one shot" out of one and the same material, which is why they are all composed of a single piece.

In this specific embodiment, it has turned out to be particularly advantageous to select an elevated injection pressure of ≥900 bar. In addition, the bristle cavities should also be embodied correspondingly; their greatest diameter should be smaller by at least a factor of 10, or better still a factor of 15 than their maximum length in the direction of the longitudinal axis of a bristle. Preferably, each of the bristle-forming cavities is ventilated at several different points spaced apart from one another.

The injection molding according to the invention, in particular at the above-mentioned elevated injection pressure, also gives the bristles their definitive use properties because in injection molded bristles that have been manufactured using the method that defines the invention, the polymer chains that constitute the bristles demonstrate a special orientation parallel to the longitudinal axis of the bristle.

As has already been mentioned above, method protection is also claimed at the relevant time, in fact particularly in the form of the following claims:

A method for manufacturing a cosmetic applicator 1 according to one of the claims in which, in a first method step, preferably through the use of an injection molding method, a blank is manufactured, which is constituted by a sealing cap 2 that forms a gripping surface on its outer circumference and is for tightly closing the cosmetic receptacle, which cap transitions integrally into a shaft 20 that protrudes from it and forms a wand section 21 and a bristle-supporting section 22, and in a second manufacturing step, the bristles 23 are injection molded onto the bristle-supporting section 22 either so that the bristle-forming plastic compound is injected into the hollow interior/cavity 24 of the bristle-supporting section 22, where the injection pressure is on the one hand selected to be high enough that the bristle-forming plastic compound breaks through the wall of the bristle-supporting section 22 in the radially outward direction wherever the wall is hollow because it is covering a bristle-forming cavity that is not yet filled at the beginning, and on the other hand is selected to be low enough that the bristle-forming plastic compound does not break through the still-warm, solid dividing section of the shaft 20 that prevents the bristle-forming plastic compound from being shot in the direction of the sealing cap 2 or so that the bristle-supporting section 22 is enclosed by and welded to a sleeve from which the bristles protrude.

A method according to the description provided in the above paragraph, characterized in that after the injection molding of the blank, the bristle-supporting section 22 is removed from the mold in which it is produced, while the rest of the blank remains in the mold cavity of the main mold used to manufacture it and is then inserted into a second mold that fully encloses its outer circumference, which has bristle-forming cavities and is brought into sealed contact with the shaft 20.

A method according to the claims and according to the description provided in the above paragraphs, in which—after the bristle-supporting section 22 is removed from the mold forming it—the main mold is rotated and only then is the bristle-supporting section 22 inserted into the mold that forms the bristles 23.

A method according to the description provided in the three preceding paragraphs, in which the parting line between the main mold and the mold that produces the bristle-supporting section lies in a plane that intersects the solid dividing section of the shaft 20.

The above-mentioned methods can include other method features or device features taken from the part of the description preceding them or from the claims.

The invention claimed is:

1. An injection-molded plastic sealing cap, comprising:

a tubular cap body with a longitudinal axis, which cap body transitions integrally into a plate that extends at least predominantly in a radial direction, wherein the plate integrally transitions into a shaft that carries an applicator or integrally transitions into a coupling for fixing a shaft that carries an applicator integrally into the shaft, in which an inner circumference of the tubular cap body has at least one holding projection that protrudes radially inward into an inner space that is circumferentially encompassed by the cap body and as a result, forms an undercut when viewed from an end opening of the tubular cap body oriented toward the holding projection, wherein the plate has a window that is associated with the at least one holding projection and through which it is possible to access the undercut from the end opening of the tubular cap body oriented away from the holding projection while the window is aligned with the holding projection with which the window is associated, viewed in a direction of the longitudinal axis of the sealing cap.

2. The injection-molded plastic sealing cap according to claim 1, wherein a cross-sectional area of the window is greater than a projected area of the holding projection with which the window is associated, viewed in the direction of the longitudinal axis.

3. The injection-molded plastic sealing cap according to claim 1, wherein the plate divides the tubular cap body into two sections, each of which has a shape of a tube that is open at an end.

4. The injection-molded plastic sealing cap according to claim 1, wherein the plate transitions into a shaft, which supports an applicator or has a coupling for attachment of a shaft that supports an applicator.

5. A cosmetic applicator, particularly in the form of a mascara applicator, comprising:

a sealing cap that forms a gripping surface according to claim 1 for tightly closing a cosmetic receptacle, which cap transitions integrally into a shaft extending from the cap, which in turn integrally comprises a wand section and a bristle-supporting section, wherein the bristle-supporting section is embodied as hollow on the inside and supports injection-molded bristles, which are integrally connected through a will of the bristle-supporting section to a plastic core, which lines or fills an interior of the bristle-supporting section, and the sealing cap and shaft are composed of a different plastic material than the plastic core inside the bristle-supporting section and the bristles.

6. The cosmetic applicator according to claim 5, wherein a cavity of the bristle-supporting section is open toward the outside at an end surface of the bristle-supporting section oriented away from the sealing cap.

7. The cosmetic applicator according to claim 5, wherein the bristle-supporting section has an essentially constant wall thickness ≤0.3 mm and a hollow region of the wand section has a wall thickness ≤2 mm.

8. The cosmetic applicator according to claim 5, wherein the wand section is at least partially hollow and has a dividing section that divides its cavity from the cavity of the bristle-supporting section in a pressure-tight way.

9. The cosmetic applicator according to claim 5, wherein the wand section, at its end oriented toward the bristle-supporting section, is solid along a dividing section that represents approximately ⅕ to ½ of its total length.

10. The cosmetic applicator according to claim 5, wherein just before a transition of the bristle-supporting section into the wand section, a wall thickness of the bristle-supporting section increases in such a way that the wall thickness of the bristle-supporting section increases toward the inside.

11. The cosmetic applicator according to claim 5, wherein the shaft is hollow all the way through and constitutes a conduit through which a plastic compound, which is injected into the inside of the bristle supporting section in order to produce the bristles, can flow into a region of an outer circumference of the sealing cap.

12. A cosmetic applicator, particularly in the form of a mascara applicator, comprising:

a sealing cap that forms a gripping surface according to claim 1 for tightly closing a cosmetic receptacle, which cap transitions into a shaft extending from the cap that ends in a bristle-supporting section, which has bristles extending outward from the bristle-supporting section, wherein the bristle-supporting section is embodied as a solid pin, which, at least along its circumference and possibly also on its end surface, is covered by a sleeve that is welded to the solid pin and forms the bristles; and the sealing cap and the shaft, which includes the wand section and the bristle-supporting section, are composed of a first plastic material in a one-piece, one-material embodiment, while the sleeve and its bristles are composed of a second plastic material, also in a one-piece, one-material embodiment.

13. A cosmetic applicator, particularly in the form of a mascara applicator, comprising:

a sealing cap that forms a gripping surface according to claim 1 for tightly closing a cosmetic receptacle, which cap transitions integrally into a shaft extending from the cap, which in turn integrally comprises a wand section and a bristle-supporting section; and the bristle-supporting section transitions integrally into outward-protruding bristles protruding outward from the bristle-supporting section, and the whole cosmetic applicator has been injection molded in a single work step.

14. The cosmetic applicator according to claim 13, wherein the sealing cap, the shaft, and the bristles are all composed of the same plastic material.

15. The cosmetic applicator according to claim 14, wherein a pressure at which the plastic compound is injected when it is injection molded into a mold cavity is greater than or equal to 900 bar, so that molecular chains forming the bristles are given an orientation in a direction of a longitudinal axis of the respective bristle.

16. The cosmetic applicator according to claim 5, wherein an outer diameter (AS) of the wand section or of a sleeve surrounding the wand section is essentially or continuously greater than an outer diameter (AB) of the bristle-supporting section, where a ratio AS/AS is ≤0.8.

17. The cosmetic applicator according to claim 5, wherein the sealing cap is embodied so that in cooperation with a corresponding matching part on the receptacle, the sealing cap forms a quick acting closure for the applicator, which is embodied as a bayonet closure or as a multi-start short thread and is embodied so that with a rotating movement ≤⅜ of a turn, the holding projection(s) of the sealing cap and the holding projection(s) of the receptacle can be moved from a completely closed position into a position in which the sealing cap is no longer attached to the receptacle in a direction along the longitudinal axis of the applicator.

18. The injection-molded plastic sealing cap according to claim 1, wherein a cross-sectional area of the window is greater than a projected area of the holding projection with Which the window is associated, viewed in the direction of the longitudinal axis.

19. The injection-molded plastic sealing cap according to claim 1, wherein the plate divides the tubular cap body into two sections, each of which has a shape of a tube that is open at an end.

20. The injection-molded plastic sealing cap according to claim 1, wherein the plate transitions into a shaft, which supports an applicator or has a coupling for attachment of a shaft that supports an applicator.

* * * * *